US005779108A

United States Patent [19]

Barriac et al.

[11] Patent Number: 5,779,108

[45] Date of Patent: Jul. 14, 1998

[54] PRESSURE VENTING TRIGGER SPRAYER

[75] Inventors: Jacques J. Barriac, Claremont; Douglas B. Dobbs, Yorba Linda, both of Calif.

[73] Assignee: Calmar Inc., City of Industry, Calif.

[21] Appl. No.: 490,887

[22] Filed: Jun. 15, 1995

[51] Int. Cl.[6] ..... B67D 5/40

[52] U.S. Cl. ..... 222/340; 222/383.1; 222/397

[58] Field of Search ..... 222/340, 341, 222/383.1, 397; 239/333

[56] References Cited

U.S. PATENT DOCUMENTS

| | | | |
|---|---|---|---|
| 3,768,734 | 10/1973 | Anderson, Jr. et al. | 222/383.1 X |
| 4,072,252 | 2/1978 | Steyns et al. | 222/341 |
| 4,230,277 | 10/1980 | Tada | 222/383.1 X |
| 4,365,751 | 12/1982 | Saito et al. | 222/383.1 X |
| 4,579,041 | 4/1986 | Organ et al. | 91/437 |
| 4,618,077 | 10/1986 | Corsette | 222/383.1 |
| 4,625,899 | 12/1986 | Stull | 222/521 |
| 4,646,947 | 3/1987 | Stull | 222/397 |
| 4,747,523 | 5/1988 | Dobbs | 222/383.1 |
| 4,773,572 | 9/1988 | Stull | 222/397 X |
| 4,819,835 | 4/1989 | Tasaki | 222/383.1 |
| 4,921,143 | 5/1990 | Billet | 222/401 X |
| 5,199,615 | 4/1993 | Downing et al. | 222/397 |
| 5,228,602 | 7/1993 | Maas et al. | 222/340 |
| 5,299,717 | 4/1994 | Geier | 222/340 |
| 5,344,053 | 9/1994 | Foster et al. | 222/383.1 |

*Primary Examiner*—Kevin P. Shaver
*Attorney, Agent, or Firm*—Watson Cole Grindle Watson, P.L.L.C.

[57] ABSTRACT

A trigger actuated pump dispenser includes a housing mounted on a container of gas/vapor producing liquid product capable of generating a superatmospheric pressure in the container, the housing including a piston/cylinder unit and a container air vent which includes a vent chamber and a vent port establishing communication between the vent chamber and the interior of the container. The air vent has a pressure vent outboard of the vent seal connected to the piston for releasing pressure from the container via the vent port and the vent chamber upon outboard movement of the piston to such outboard location in response to the superatmospheric pressure in the container.

11 Claims, 1 Drawing Sheet

PRESSURE VENTING TRIGGER SPRAYER

BACKGROUND OF THE INVENTION

This invention relates generally to a trigger actuated pump sprayer, and more particularly to such a sprayer which has means for venting superatmospheric pressure from a container and from confined areas of the pump sprayer housing when the trigger sprayer is mounted on a container of gas/vapor producing liquid product capable of generating superatmospheric pressure in the container.

Trigger sprayers of the known type, as disclosed in U.S. Pat. Nos. 4,747,523, 4,072,252 and 5,344,053, include means for venting the container to atmosphere during the pumping operation to replenish product dispensed from the container with air to avoid hydraulic lock and container collapse.

A container vent valve connected to the piston for movement together therewith during piston reciprocation slides within a vent chamber having a vent port or passage which communicates with the interior of the container. The container vent seal is responsive to piston reciprocation for enabling communication and preventing communication of the interior of the container with the atmosphere through the vent opening/passage and the vent chamber.

Also, confined areas of the pump housing, such as the pump chamber, the inlet passage and the discharge passage, are in communication with the interior of the container.

When the trigger sprayer in accordance with any of these prior art types is mounted on a container of gas/vapor producing liquid product such as a cleaning chemical capable of generating an elevated pressure in the container, such internal container pressure, being in communication with the vent chamber via the vent port or vent passage, tends to force the pump piston out of its cylinder, exerting undue pressure against the trigger lever. Also, since the product formulation in the container is unstable, it tends to generate a certain amount of gas with a pressure sufficient to deform the container sidewalls outwardly.

Upon outboard extension of the piston, leakage from the pump chamber can occur. And, the outwardly extended piston interferes with the function and efficient operation of the sprayer as it may require a higher force to actuate the trigger against the force of the internal pressure and may cause an unpredictable lost motion of the piston upon trigger actuation as to interfere with the piston compression stroke.

Moreover, since the superatmospheric pressure of the container communicates with confined areas of the pump housing such as the pump chamber and the inlet and discharge passages, trigger actuation of the piston is further impeded, and the product tends to be discharge initially in sputters and spurts until the pressure within the dispenser system reaches atmospheric.

The superatmospheric pressure under the aforedescribed conditions must therefore be vented to avoid leakage and achieve a smooth and efficiently operating trigger actuated pump sprayer.

SUMMARY OF THE INVENTION

It is therefore an object of the present invention to provide automatic pressure venting which functions in the manner of a pressure release valve for a trigger sprayer mounted on a container of formulation which may build up pressure from gas generated by a chemical reaction, thereby introducing a safety feature and permitting a leak-free and efficient operation of the sprayer.

According to the invention, a first pressure vent in the form of a rib or a groove extending in the direction of piston reciprocation is formed at the wall of the container vent chamber at a location outboard of the container vent seal for releasing pressure from the container via the vent port/passage and the vent chamber upon outboard movement of the piston to such outboard location in response to the superatmospheric pressure in the container.

Further according to the invention, a second pressure vent may be provided in the form of a rib or a groove extending in the direction of piston reciprocation at the wall of the pump cylinder at a location outboard of the piston seal for releasing the pressure from the pump chamber as well as the inlet and outlet passages around the piston seal and via the first pressure vent upon the outboard movement of the piston in response to the internal pressure generated within the container.

Outboard movement of the piston in response to such internal generated pressure is resiliently resisted by the trigger lever provided with a spring cushioning effect which may be in the form of an integral spring devised as an open slot in that portion of the trigger which bears against the pump housing. This spring reaction tends to return the piston to its original non-pumping position in readiness for reciprocation by the trigger after pressure venting.

The spring return for the piston may be a conventional "wet" spring located in the pump cylinder, or may be in the form of an external "dry" spring acting between the piston and the trigger lever for extracting the piston during each piston return stroke. The external spring may have a pair of spring legs straddling the sides of the pump cylinder and bearing against an external wall of the pump housing. A rod formed integrally with the piston has a live hinge and bears against the underside of the trigger, one end of the external spring engaging an opening in an outer end of that rod for spring biasing the lever relative to the piston.

Other objects, advantages and novel features of the invention will become more apparent from the following detailed description of the invention when taken in conjunction with the accompanying drawings.

DETAILED DESCRIPTION OF THE INVENTION

Figure 1:
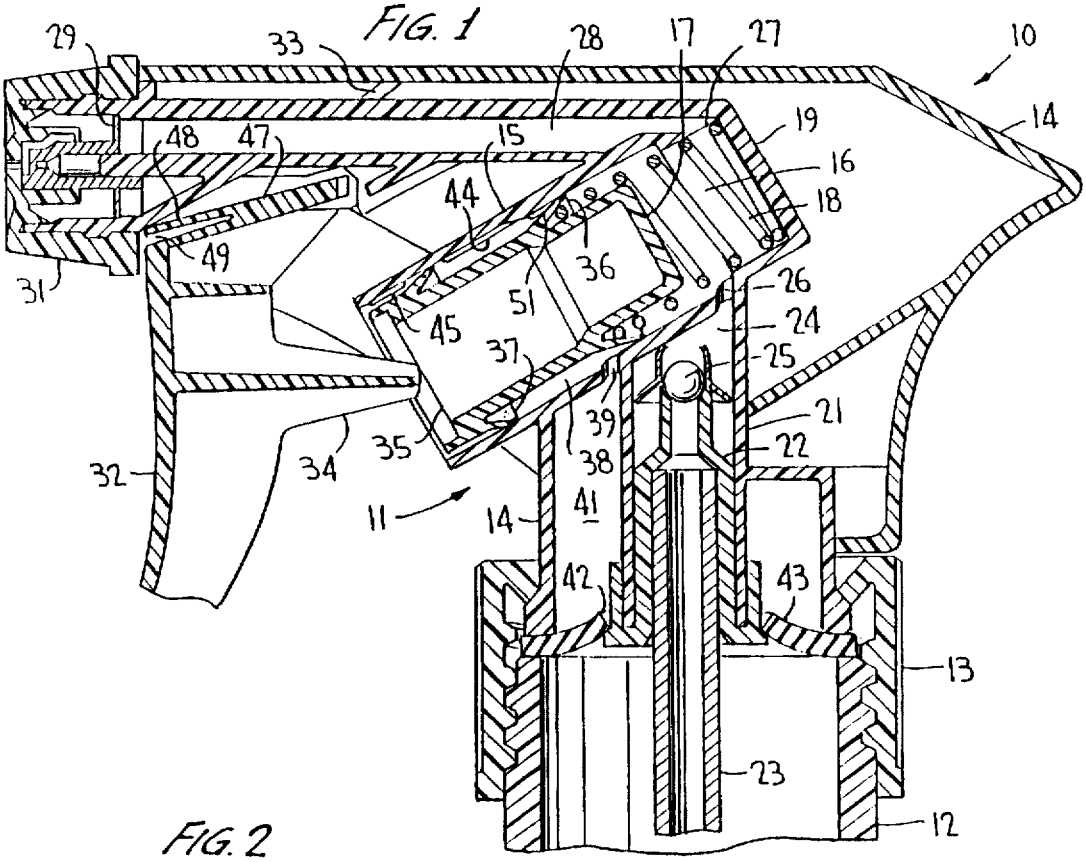
FIG. 1 is a vertical sectional view of a trigger sprayer of known construction mounted on a container, and incorporating the features of the invention.

Turning now to the drawings wherein like reference characters refer to like and corresponding parts throughout the several views, trigger sprayer 10 shown in FIG. 1 has a sprayer housing 11 mounted on neck 12 of the container not otherwise shown by the provision of a threaded closure cap 13. The sprayer housing is typically covered by an ornamental shroud 14 coupled thereto in any normal manner.

The closure may be snap-fitted to engage with the lower end of a cylindrical neck portion 14 of the housing, or the closure may otherwise engage the neck portion in some other suitable manner forming no part of the invention.

The housing includes the pump cylinder 15 open at its outer end and having at its inner end region a pump chamber 16 for a manually reciprocable pump piston 17. An internal, or "wet," coil return spring 18 extends between end wall 19 of the pump cylinder and some suitable portion of the piston for returning the piston to its non-pumping, inoperative position of FIG. 1.

An inner cylinder 21 of the sprayer housing supports a tube retainer 22 which suspends a conventional dip tube 23 extending into the container. The dip tube and upper end of the tube retainer define an inlet passage 24 which is valve controlled by a conventional ball check valve 25 supported on a valve seat at the upper end of the tube retainer.

The inlet passage terminates in an inlet port 26 which opens into the pump chamber. A discharge port 27 opening from the pump chamber communicates with a discharge passage 28 which is valve controlled by an annular flap valve 29 located within a rotatable nozzle cap 31.

A trigger actuator 32 is hinged to the sprayer housing in some suitable manner as at 33, the trigger in the FIG. 1 embodiment having a tup 34 bearing against an outer circular rim 35 of the piston.

The piston has an inboard annular piston seal 36, which may be in the form of an inwardly directed chevron seal, in sliding sealing engagement with the wall of the pump chamber during pumping operation. A container vent seal 37 on the piston, which may be in the form of an inwardly directed chevron seal, is spaced outboard of the piston seal, forming an annular vent chamber 38 together therewith. The vent chamber communicates with the interior of the container via a vent port 39 located in the wall of the vent chamber, a passage 41 between 14 and 21, and an out-of-round opening 42 of a gasket seal 43 located between the lower end of neck portion 14 and the upper end of the container neck.

In the embodiment shown, an axial rib or groove 44 is provided at a suitable location at the wall of the vent chamber for breaking the seal between vent seal 37 and that wall during pumping operation for opening the container vent passage 39, 41, 42 to atmosphere for admitting air into the container to replace product dispensed during each pumping pressure stroke to avoid hydraulic lock and container collapse. Such a container vent feature is disclosed in U.S. Pat. No. 4,747,523 and U.S. Pat. No. 4,618,077. Otherwise, rib/groove 44 could be eliminated and vent port 39 can be located at a location outboard from that shown such that vent seal 37 slides across the vent port during pumping operation for opening and closing the vent passage to atmosphere, without departing from the invention. Such a container vent feature is disclosed in U.S. Pat. No. 4,072,252 and in U.S. Pat. No. 5,344,053, the latter having a vent chamber which is not coaxial with the pump chamber.

Figure 2:
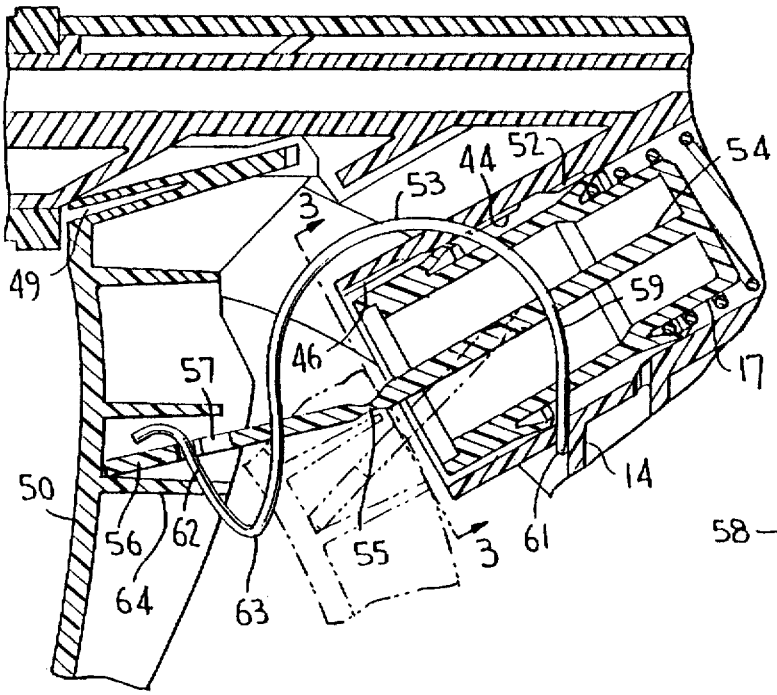
FIG. 2 is a view similar to FIG. 1, showing an alternate, external piston return spring according to the invention.

In accordance with the invention, a first pressure vent, which may be in the form of an axial rib 45 (FIG. 1) or an axial groove 46 (FIG. 2), is provided at the wall of vent chamber 38 at a location outboard of vent seal 37 in the inoperative, non-pumping position of the piston shown in FIGS. 1 and 2. Thus, when the container contains a formulation which may build up pressure exceeding atmospheric from a gas generated by a chemical reaction or the like, that superatmospheric pressure tends to expand the walls of the plastic container outwardly, and to extend the piston out of its cylinder bore as the gas communicates with the container vent chamber through the container vent passage. As the piston is forced outwardly under this pressure, the container vent seal 37 shifts with the piston to the location of the pressure vent rib or groove 45, 46, which breaks the seal, establishing a pressure vent passage or passages to atmosphere. Superatmospheric pressure is thus vented from the interior of the container via container vent passage 39, 41, 42, vent chamber 38 and the pressure vent passage or passages established as container vent seal 37 is either deformed by rib 45 or slides across groove 46.

Also, as the superatmospheric pressure within the container causes the piston to shift outwardly of its cylinder bore, the piston tends to place the trigger lever in tension as an arm 47 of the trigger bears against a confronting portion of the sprayer housing. This undue tension is undesirable as it interferes with the smooth and efficient operation of the pump.

Leakage from the pump chamber can occur during the outboard piston movement as well. In accordance with another feature of the invention, a spring acting between the sprayer housing and the piston is provided for resiliently resisting the outboard movement of the piston and for returning the piston to its at-rest, non-pumping position of FIG. 1. Such a spring may be in the form of an integral spring, such as a leaf spring 48 formed by an open slit 49 in arm 47 of the trigger lever. Other integral or external resilient means may be provided without departing from the invention.

Another, or second, pressure vent is provided according to the invention in the form of an axial rib 51 (FIG. 1) or an axial groove 52 (FIG. 2) at the wall of the pump chamber at a location outboard of piston seal 36. Therefore, during outboard movement of the piston in response to the elevated pressure within the container acting on the piston both through vent chamber 38 and through the pump chamber via the inlet passage, the elevated pressure from pump chamber 16 and from the inlet and outlet passages 24 and 28 are vented to atmosphere as the seal between piston seal 36 and the wall of the pump chamber is broken upon engagement between seal 36 and rib 51 or groove 52. Pressure from the pump chamber and the inlet and outlet passages is released to the outside via vent chamber 38 and the pressure vent passage established upon the breaking of the seal of container vent seal 37 as aforedescribed.

The outboard movement of the piston in response to the elevated temperature within the container is utilized for automatically pressure venting the container and the confined areas of the sprayer housing to avoid interference with a smooth and efficient pumping operation. Leakage from the pump chamber during piston outboard movement is avoided as the piston is automatically returned to its initial, non-pumping position by a spring force acting against the outer end of the piston.

Figure 3:
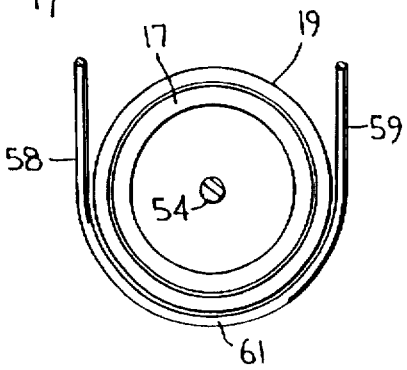
FIG. 3 is a view taken substantially along the line 3—3 of FIG. 2.

An alternative, external, "dry," piston return spring 53, shown in FIGS. 2 to 4 may be provided according to the invention. Tup 34 on trigger lever 50 is eliminated, and instead a coaxial rod 54 is molded within the hollow piston, the rod having a live hinge 55 forming an outer extension 56 having an opening 57.

Spring 53 may be in the form of a spring clip having a pair of spaced curved legs 58, 59, straddling opposing sides of the pump cylinder (FIG. 3) and having a bight portion 61 extending about the underside of the pump cylinder and bearing against the outside of neck portion 14.

Legs 58, 59 may each terminate in a clip 62 extending through opening 57 and joined at a spring bend 63 to the main portion of the legs. Otherwise, legs 58, 59 may be joined at bend 63 and single clip 62 may extend from that bend through opening 57.

The external spring resiliently couples rod 54 of the piston against the inner face of the trigger lever, extension 56 bearing against an inner transverse wall 64 of the trigger. Thus, as compared to the spring action of internal spring 18 which pushes the piston out of its cylinder bore during each return stroke, the external spring effectively pulls the piston out of its cylinder bore during each piston return stroke as the external spring resiliently forces extension 56 against the trigger lever. Extension 56 is not otherwise connected to the trigger lever, such that internal and external springs can be easily substituted by simply substituting the piston return springs, the pistons and the trigger levers.

Otherwise, the embodiment of FIG. 2 has the same pressure venting features and integral trigger lever spring means for the piston as described with reference to FIG. 1.

The pressure venting according to the invention is automatic and operates whenever the elevated pressure within the container needs to be vented, as the pressure venting systems takes advantage of the outboard shifting movement of the piston in response to that elevated pressure. The piston is returned to its initial, non-pumping position by a resilient trigger lever, again automatically, to avoid leakage from the pump cylinder and to avoid interference with the smooth and efficient pumping operation. By pressure venting the container, the pump operates more efficiently without leakage from the discharge nozzle, and performs as though the trigger sprayer was mounted on a container not containing a formulation which tends to build up pressure from gas generated by a chemical reaction of liquid ingredients in the container.

Upon pressure venting as aforedescribed, the pump sprayer operates and functions as a standard trigger actuated dispenser in that liquid product is drawn into the pump chamber via the dip tube during each suction stroke and is expelled from the pump chamber during each pressure stroke applied by operation of the trigger lever.

Obviously, many modifications and variations of the present invention are made possible in the light of the above teachings. It is therefore to be understood that within the scope of the appended claims, the invention may be practiced otherwise than as specifically described.

What is claimed is:

1. A trigger actuated pump dispenser, comprising, a housing means mounted on a container of gas/vapor producing liquid product capable of generating a superatmospheric pressure in the container, said housing means having pump cylinder means open at its outer end to atmosphere and having at its inner end region a pump chamber for a manually reciprocable piston, said housing having container air vent means including a vent chamber and a vent port establishing communication between said vent chamber and the interior of the container, said housing means having inlet and outlet means for delivering the product into and out of said pump chamber, a trigger lever hinged to said housing means in engagement with said piston for manual reciprocation thereof between non-pumping and pumping positions, means on said piston for reciprocation together therewith, said means on said piston cooperating with said air vent means for opening and closing said vent chamber to atmosphere during piston reciprocation between said positions, and said air vent means having first pressure vent means at a location outboard of said means on said piston in said non-pumping position for releasing the pressure from the container via said vent port and said vent chamber upon outboard movement of said piston to said outboard location in response to the superatmospheric pressure in the container.

2. The dispenser according to claim 1, wherein said means on said piston comprises an annular vent seal.

3. The dispenser according to claim 1, wherein said first pressure vent means comprises a groove at a wall of said air vent means containing said vent port, said groove extending in the direction of piston reciprocation.

4. The dispenser according to claim 1, wherein said first pressure vent means comprises a rib at a wall of said air vent means containing said vent port, said rib extending in the direction of piston reciprocation.

5. The dispenser according to claim 1, further comprising resilient means acting between said housing means and said piston for resiliently resisting the outboard movement of said piston and for returning said piston to said non-pumping position.

6. The dispenser according to claim 5, wherein said resilient means is integral with said trigger lever.

7. The dispenser according to claim 5, wherein a portion of said lever bears against said housing means, said lever portion having an open slit defining said resilient means.

8. The dispenser according to claim 2, wherein said piston has an annular piston seal, said vent seal being axially spaced from said piston seal to define said vent chamber therebetween.

9. The dispenser according to claim 1, wherein said piston has an annular piston seal, said cylinder means having a second pressure vent means at a location outboard of said piston seal in said non-pumping position for releasing the pressure from said pump chamber and said inlet and outlet means via said first pressure vent means upon said outboard movement of said piston.

10. The dispenser according to claim 9, wherein said second pressure vent means comprises a rib at a wall of said cylinder means, said rib extending in the direction of piston reciprocation.

11. The dispenser according to claim 9, wherein said second pressure vent means comprises a groove at a wall of said cylinder means, said groove extending in the direction of piston reciprocation.

* * * * *